US012016435B2

(12) United States Patent
Uozumi et al.

(10) Patent No.: US 12,016,435 B2
(45) Date of Patent: Jun. 25, 2024

(54) KNITTED FASTENER STRINGER, FASTENER CHAIN, AND METHOD FOR MANUFACTURING KNITTED FASTENER STRINGER

(71) Applicant: YKK Corporation, Tokyo (JP)

(72) Inventors: Norio Uozumi, Kurobe (JP); Takashi Saito, Kurobe (JP)

(73) Assignee: YKK Corporation, Tokyo (JP)

( * ) Notice: Subject to any disclaimer, the term of this patent is extended or adjusted under 35 U.S.C. 154(b) by 202 days.

(21) Appl. No.: 17/765,078

(22) PCT Filed: Oct. 16, 2019

(86) PCT No.: PCT/JP2019/040625
§ 371 (c)(1),
(2) Date: Mar. 30, 2022

(87) PCT Pub. No.: WO2021/074992
PCT Pub. Date: Apr. 22, 2021

(65) Prior Publication Data
US 2022/0386747 A1 Dec. 8, 2022

(51) Int. Cl.
*A44B 19/34* (2006.01)
*A44B 19/56* (2006.01)
*D04B 21/16* (2006.01)

(52) U.S. Cl.
CPC ..... *A44B 19/343* (2013.01); *A44B 19/56* (2013.01); *D04B 21/16* (2013.01); *D10B 2501/0631* (2013.01)

(58) Field of Classification Search
CPC ..... A44B 19/343; A44B 19/56; D04B 21/16; D10B 2501/0631
See application file for complete search history.

(56) References Cited

U.S. PATENT DOCUMENTS 5,857,359 A 1/1999 Matsuda et al.
6,427,294 B1 8/2002 Shibaike et al.
6,651,296 B2 * 11/2003 Matsuda ..... D04B 21/16 66/193
2005/0178161 A1 8/2005 Matsuda et al.
(Continued)

FOREIGN PATENT DOCUMENTS

EP 0741980 A2 11/1996
EP 0741980 A3 3/1997
(Continued)

OTHER PUBLICATIONS

Office Action, Japanese Patent Application No. 2021-552031, Aug. 12, 2022, 8 pages.
(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

A knitted fastener stringer has a chain stich yarn disposed on the innermost edge wale furthest from the tape body portion of an element attaching portion is the thickest of all the chain stich yarns used in a fastener tape. This enables a distance of a gap formed between left and right fastener tapes to be smaller when a slide fastener is formed by two knitted fastener stringers.

10 Claims, 3 Drawing Sheets

(56) References Cited

U.S. PATENT DOCUMENTS

| | | | | |
|---|---|---|---|---|
| 2006/0213235 | A1* | 9/2006 | Matsuda | A44B 19/56 66/192 |
| 2007/0089466 | A1* | 4/2007 | Ikeguchi | D04B 21/16 66/195 |
| 2007/0227198 | A1 | 10/2007 | Wakata et al. | |
| 2008/0301914 | A1* | 12/2008 | Hung | A44B 19/346 24/381 |
| 2012/0279025 | A1 | 11/2012 | Keguchi et al. | |
| 2013/0022778 | A1 | 1/2013 | Wakata et al. | |
| 2013/0174767 | A1 | 7/2013 | Hirokawa et al. | |
| 2014/0123444 | A1 | 5/2014 | Uozumi et al. | |

FOREIGN PATENT DOCUMENTS

| | | | |
|---|---|---|---|
| EP | 1048237 | A1 | 11/2000 |
| EP | 1839514 | A1 | 10/2007 |
| GB | 1405134 | A | 9/1975 |
| JP | S54-006940 | B2 | 4/1979 |
| JP | 2000-312604 | A | 11/2000 |
| JP | 3396335 | B2 | 2/2003 |
| JP | 2004-261246 | A | 9/2004 |
| JP | 2005-230040 | A | 9/2005 |
| TW | 200744494 | A | 12/2007 |
| TW | 201212844 | A1 | 4/2012 |
| WO | 2011/077568 | A1 | 6/2011 |
| WO | 2011/121702 | A1 | 10/2011 |
| WO | 2013/011559 | A1 | 1/2013 |

OTHER PUBLICATIONS

Extended European Search Report, European Patent Application No. 19948957.6, Sep. 9, 2022, 9 pages.

International Search Report, PCT Patent Application No. PCT/JP2019/040625, Nov. 19, 2019.

Office Action, Taiwanese Patent Application No. 109113132, Jan. 13, 2021.

* cited by examiner

KNITTED FASTENER STRINGER, FASTENER CHAIN, AND METHOD FOR MANUFACTURING KNITTED FASTENER STRINGER

TECHNICAL FIELD

The present invention relates to a knitted fastener stringer of which fastener elements are knitted in a fastener tape, a fastener chain including the knitted fastener stringer, and a method for manufacturing the knitted fastener stringer.

BACKGROUND ART

A knitted fastener stringer is known as one of fastener stringers for slide fasteners. In a knitted fastener stringer, a continuous plurality of fastener elements formed of monofilament made of synthetic resin are knitted in a tape side edge portion of a fastener tape.

In this case, a portion of the fastener tape in which the fastener elements are knitted is called an element attaching portion. A knitted fastener stringer is manufactured, for example, using a double warp knitting machine with two rows of needle beds by knitting the continuous fastener elements in the element attaching portion of the fastener tape while knitting the fastener tape.

An example of a knitted fastener stringer is disclosed in, for example, WO2011/077568 A1 (Patent Document 1) and WO2013/011559 A1 (Patent Document 2).

In the knitted fastener stringer of Patent Document 1, a ground structure of the element attaching portion of the fastener tape is knitted in a single structure by chain stitch yarns, tricot yarns, and two needle stitch yarns. Each fastener element is sandwiched and fixed by this ground structure of the element attaching portion and fixing chain stich yarns knitted in a single structure.

In the knitted fastener stringer of Patent Document 2, a ground structure of the element attaching portion is knitted in a single structure by chain stich yarns, two needle stitch yarns or tricot yarns, and weft insertion yarns inserted in a zigzag pattern over two wales. Additionally, fixing chain stitch yarns for fixing the fastener elements are knitted in a double structure that forms the first needle loops interlaced with needle loops of the ground structure and the second needle loops holding down the fastener elements.

A knitted fastener stringer is formed with the fastener elements directly knitted in the fastener tape including a warp knitting structure. For this reason, a slide fastener manufactured using a knitted fastener stringer is preferably used for clothing such as underwear and thin outer wear because it is thin in thickness and excellent in flexibility.

CITATION LIST

Patent Documents

Patent Document 1: WO2011/077568 A1
Patent Document 2: WO2013/011559 A1

SUMMARY OF INVENTION

Technical Problem

In recent years, improving properties according to respective usage, or enhancing added value by granting various functions have been done in various products including garments such as clothing. For example, in the case of clothing for daily use, it is often required to reduce the weight, to increase the flexibility, to improve the texture of such clothing, to make it more comfortable to wear, and the like.

For this reason, there are various requests for the slide fasteners to be attached to clothing. For example, for a slide fastener including a knitted slide fastener stringer, it is required to make the slide fastener thinner, to enhance the flexibility further, to improve the texture better, to increase the tape strength of a fastener tape, and the like.

By the way, as one form of slide fasteners, so-called a back use type slide fastener is known, of which fastener elements are attached on a tape back surface side of a fastener tape so that the fastener elements are not visible in a closed state of the slide fastener. When such a back use type slide fastener is manufactured using a knitted fastener stringer, it is more likely to form a gap between the left and right fastener tapes in a closed state of the slide fastener compared to, for example, a widely known back use type slide fastener of which the fastener elements are sewn on a fastener tape of a woven structure. As a result, in the case of a back use type slide fastener including a knitted fastener stringer, there is a possibility that parts of the fastener elements disposed hidden behind the fastener tapes are easily visible from the gap between the left and right fastener tapes.

Additionally, in the case of a back use type slide fastener, the slide fastener can be provided with a water repellence property for making it difficult for liquid such as water to penetrate from one tape surface side to the other tape surface side of fastener tapes in a closed state of the slide fastener, by attaching a film member made of synthetic resin to the fastener tape and by applying water repellent treatment to the fastener tape. Such a slide fastener with a water repellence property is generally called a water repellent treated slide fastener.

In the case of a back use type slide fastener including a knitted slide fastener stringer, however, as the gap as described above is formed between the left and right fastener tapes, the film member is sometimes disposed protruding above this gap between the fastener tapes upon attaching the film member made of synthetic resin to the fastener tapes. As a result, a part of the film member protruding from the fastener tape seems like a straight white line along a tape length direction, there is a fear that it may lead reduction in the appearance quality of the slide fastener. Additionally, if the gap described above is formed between the left and right fastener tapes, it may also lead reduction in the water repellence property of the slide fastener. Therefore, knitted slide fastener stringers have been rarely used for back use type water repellent treated slide fasteners.

The present invention has been made in consideration of the above conventional problems, and the object is to provide a knitted fastener stringer in which a gap formed between left and right fastener tapes can be smaller in a closed state of a slide faster, a fastener chain including the knitted fastener stringers, and a method for manufacturing the knitted fastener stringer.

Solution to Problem

To achieve the above object, a knitted fastener stringer provided by the present invention is a knitted fastener stringer comprising, a fastener tape including a warp knitting structure, and a plurality of fastener elements formed of monofilament made of synthetic resin, wherein the fastener tape includes a tape body portion, and an element attaching portion extending from one side edge portion of the tape body portion in a tape width direction and in which a part of the fastener element is knitted, wherein the fastener tape includes a plurality of chain stitch yarns forming a plurality of needle loops in a chain shape along a wale direction, being characterized in that the chain stitch yarn disposed on the innermost edge wale furthest from the tape body portion of the element attaching portion is the thickest of all the chain stitch yarns used in the fastener tape.

In the knitted fastener stringer according to the present invention, it is preferable that the fastener tape includes a ground structure knitted in a single structure by the chain stitch yarn, a single satin stitch yarn alternately forms needle loops on two wales disposed three rows distant position from each other, and a weft insertion yarn inserted over a plurality of wales in a zigzag pattern, and the fastener element is inserted and knitted between the ground structure of the fastener tape and a fixing chain stitch yarn knitted in a single structure.

In this case, it is preferable that at least three of the single satin stitch yarns and the at least two of the weft insertion yarns are disposed in directions crossing each other in an interval between wales being a boundary portion of the tape body portion and the element attaching portion.

Additionally, it is preferable that the single satin stitch yarns include a first single satin stitch yarn alternately forms needle loops on a wale of the element attaching portion and on a wale of the tape body portion, and a second single satin stitch yarn alternately forms needle loops on two wales of the tape body portion, the first single satin stitch yarn is thicker than the second single satin stitch yarn.

Furthermore, it is preferable that the needle loops that form the outermost edge wale of the tape body portion disposed on the position furthest from the element attaching portion, include only needle loops of the chain stitch yarn, and the needle loops that form wales except the outermost edge wale of the tape body portion include the needle loops of the chain stitch yarn and the needle loops of the single satin stitch yarn.

Next, a fastener chain provided by the present invention is characterized by comprising the two knitted fastener stringers including the forms described above.

In the fastener chain of the present invention, it is preferable that a distance between the two fastener tapes is 0.35 mm or less.

Additionally, it is preferable that the fastener tape includes a first tape surface on the side which the fastener elements are knitted, and a second tape surface on the opposite side of the first tape surface, and a film member made of synthetic resin is attached on the second tape surface of the fastener tape.

Next, a manufacturing method for a knitted fastener stringer provided by the present invention is a manufacturing method for a knitted fastener stringer comprising, a fastener tape including a warp knitting structure, and a plurality of fastener elements formed of monofilament made of synthetic resin, wherein the fastener tape includes a tape body portion, and an element attaching portion extending from one side edge portion of the tape body portion in a tape width direction and in which a part of the fastener element is knitted, wherein the fastener tape includes a plurality of chain stitch yarns forming a plurality of needle loops in a chain shape along a wale direction, and being characterized in that the method including using a thickest yarn of all the chain stitch yarns used in the fastener tape for the chain stitch yarn disposed on the innermost edge wale furthest from the tape body portion of the element attaching portion.

The manufacturing method for the knitted fastener stringer according to the present invention preferably includes inserting and knitting the fastener elements between a ground structure of the fastener tape and a fixing chain stitch yarn knitted in a single structure while knitting the ground structure of the fastener tape in a single structure by using the chain stitch yarn, a single satin stitch yarn alternately forms needle loops on two wales disposed three rows distant position from each other, and a weft insertion yarn inserted over a plurality of wales in a zigzag pattern.

Advantageous Effects of Invention

In the knitted fastener stringer according to the present invention, the belt-shaped fastener tape formed long in one direction includes a plurality of the chain stitch yarns. Additionally, the thickest yarn of all the chain stitch yarns used in the fastener tape is used for the chain stitch yarn disposed on the innermost edge wale furthest from the tape body portion of the element attaching portion. This enables a position of the innermost edge wale in a tape width direction to be more distant from the tape body portion of the fastener tape compared to the case in which, for example, the chain stitch yarn disposed on the innermost edge wale is the same thickness as other chain stitch yarns. Thus, when a fastener chain or a slide fastener is formed by combining the two knitted fastener stringers, a distance of the gap formed between the left and right fastener tapes can be smaller, specifically, the distance of the gap can be small as 0.35 mm or less.

In the fastener stringer according to the present invention, the fastener tape includes the ground structure knitted in a single structure using the chain stitch yarn, the single satin stitch yarn, and the weft insertion yarn. Here, the single satin stitch yarn refers to a yarn alternately forms needle loops on two wales disposed three wales distant from each other (in other words, two wales with two wales disposed between them). This single satin stitch yarn is also simply called a satin stitch yarn. In the present invention, on knitting such a fastener tape, the fastener element is inserted and knitted one by one in a sequence between the ground structure of the fastener tape of a single structure, and the fixing chain stitch yarn of a single structure knitted by a different needle bed from that of the ground structure.

In the ground structure of the fastener tape of the present invention, tricot yarns and two needle stitch yarns are not knitted but the single satin stitch yarns described above are knitted. For this reason, the needle loops formed on two wales of each single satin stitch yarn are properly distant from each other, and thus the sinker loops of the single satin stitch yarns disposed between the needle loops of these distant wales can be made long. As a result, the knitted fastener stringer of the present invention can improve flexibility compared to the knitted fastener stringers including tricot yarns and two needle stitch yarns such as Patent Document 1 and Patent Document 2. Furthermore, the knitted fastener stringer of the present invention has a high flexibility compared to, for example, a fastener stringer of which fastener elements are separately attached to a fastener tape (a knit tape) after knitting by sewing process (in other words, a non-knitted fastener stringer).

Additionally, it becomes newly discovered that below effect can be obtained in relation to the texture of the knitted fastener stringer. That is, in the knitted fastener stringer of the present invention, the sinker loops of the single satin stitch yarns are disposed long in an inclined direction to a course direction between each of the courses. A tape surface of the fastener tape on the side which sinker loops appear can be formed into a smooth surface such as satin weave fabric by the fastener tape including such long sinker loops inclined to a course direction. Thus, the fastener tape of the knitted fastener stringer of the present invention can have a better texture than the knitted fastener stringers of such as Patent Document 1 and Patent Document 2.

In such a knitted fastener stringer of the present invention, at least three of the single satin stitch yarns and at least two of the weft insertion yarns are disposed in directions crossing each other in an interval between the wales being a boundary portion of the tape body portion and the element attaching portion. For this reason, the tape strength of the fastener tape, especially the tape strength between the tape body portion and the element attaching portion of the fastener tape can be effectively enhanced.

The single satin stitch yarns of the present invention include the first single satin stitch yarn alternately forms needle loops on the wale of the element attaching portion and the wale of the tape body portion, and the second single satin stitch yarn alternately forms needle loops on two wales of the tape body portion. Additionally, the first single satin stitch yarn is thicker than the second single satin stitch yarn. For this reason, the tape strength of the element attaching portion and the tape strength between the tape body portion and the element attaching portion of the fastener tape can be more effectively enhanced.

In the knitted fastener stringer of the present invention, the needle loops that form the outermost edge wale of the tape body portion disposed on the most distant position from the element attaching portion, include only needle loops of the chain stitch yarn. Additionally, the needle loops that form the wales except the outermost edge wale of the tape body portion include needle loops of the chain stitch yarns and needle loops of the single satin stitch yarns. This secures an appropriate tape strength of the fastener tape, allows the number of the needle loops formed on the outermost edge wale of the fastener tape to be minimized, and enables the one tape side edge of the fastener tape of the opposite side of the element attaching portion to be thin.

Thus, by making the one tape side edge of the fastener tape thin, it is easier to make the fastener tape felt thinner when touched with fingers.

Next, the fastener chain provided by the present invention comprising the two knitted fastener stringers including the forms described above. Such a fastener chain of the present invention can have a high flexibility and a good texture.

Additionally, in the fastener chain of the present invention, a distance of the gap between the two fastener tapes is small as 0.35 mm or less. Thus, a back use type slide fastener formed using the fastener chains of the present invention can make the fastener elements disposed on the back side of the fastener tapes difficult to be visible from the gap between the two fastener tapes compared to, for example, a back use type slide fastener formed using conventional fastener chains.

Additionally, in manufacturing a water repellent treated slide fastener by attaching the film member made of synthetic resin and by applying water repellent treatment to the back use type slide fastener described above, a white line between the left and right fastener tapes (that is, a part of the film member protruding from the fastener tape) as seen in a conventional water repellent treated slide fastener can be made difficult to appear.

Furthermore, in the fastener chain of the present invention, the fastener tape includes the first tape surface on the side which the fastener elements are knitted, and the second tape surface on the opposite side of the first tape surface, and the film member made of synthetic resin is attached on the second tape surface of the fastener tape. Thus, a water repellent treated slide fastener can be manufactured, for example, by applying water repellent treatment to the fastener chain.

Next, the method for manufacturing the knitted fastener stringer provided by the present invention comprises using the thickest yarn of all the chain stitch yarns used in the fastener tape for the chain stitch yarn disposed on the innermost edge wale furthest from the tape body portion of the element attaching portion. Thus, it is possible to stably manufacture the knitted fastener stringer, in which a distance of the gap formed between the left and right fastener tapes can be smaller in combining the two knitted fastener stringers to form the fastener chain or the slide fastener.

Additionally, the method for manufacturing the knitted fastener stringer of the present invention comprises inserting and knitting the fastener elements between the ground structure of the fastener tape and the fixing chain stitch yarn knitted in a single structure while knitting the ground structure of the fastener tape in a single structure by using the chain stitch yarn, the single satin stitch yarn, and the weft insertion yarn. This enables to stably manufacture the knitted fastener stringer with a high flexibility and a good texture.

DESCRIPTION OF EMBODIMENT

Figure 1:
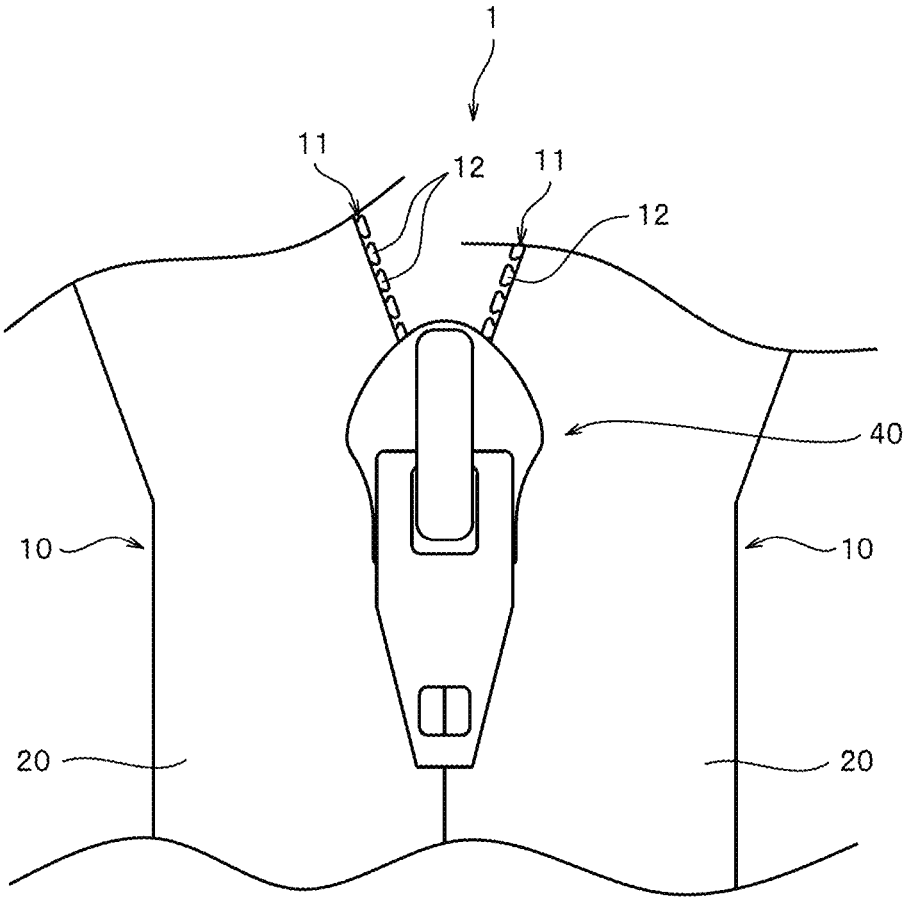
FIG. 1 is a plan view schematically showing a water repellent treated slide fastener according to an embodiment of the present invention.

Hereinafter, a preferred embodiment of the present invention is described in detail referring to the drawings. Note that, the present invention is not limited to the embodiment described hereinafter at all, various modifications can be made if they have structures and functional effects substantially identical to the present invention. For example, in the present invention, thicknesses of each of the yarns and weft insertion yarns forming a fastener tape of a knitted fastener stringer are not particularly limited, and can be changed freely.

Figure 2:
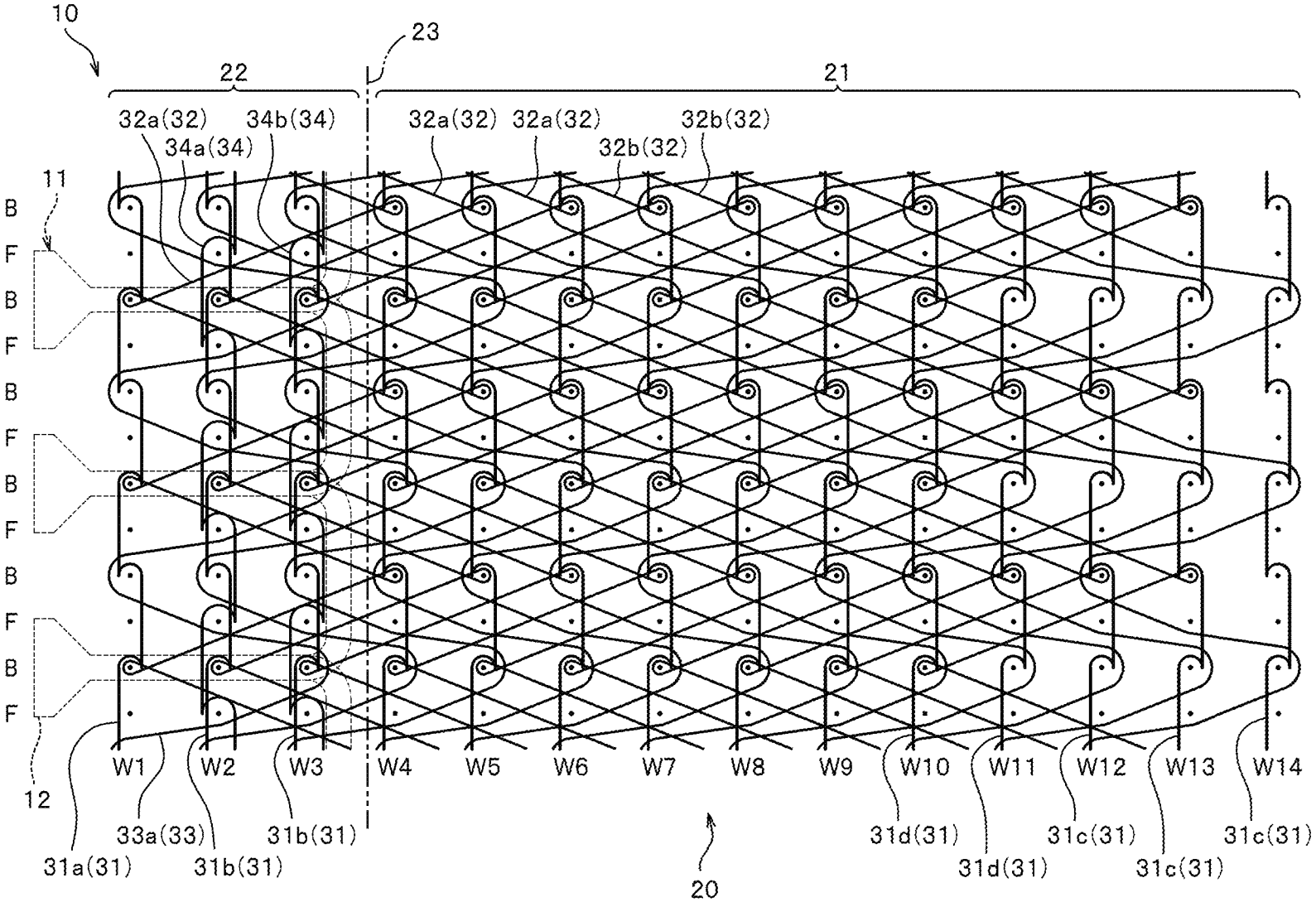
FIG. 2 is a structure diagram showing a knitting structure of a knitted fastener stringer used for the water repellent treated slide fastener shown in FIG. 1.
Figure 3:
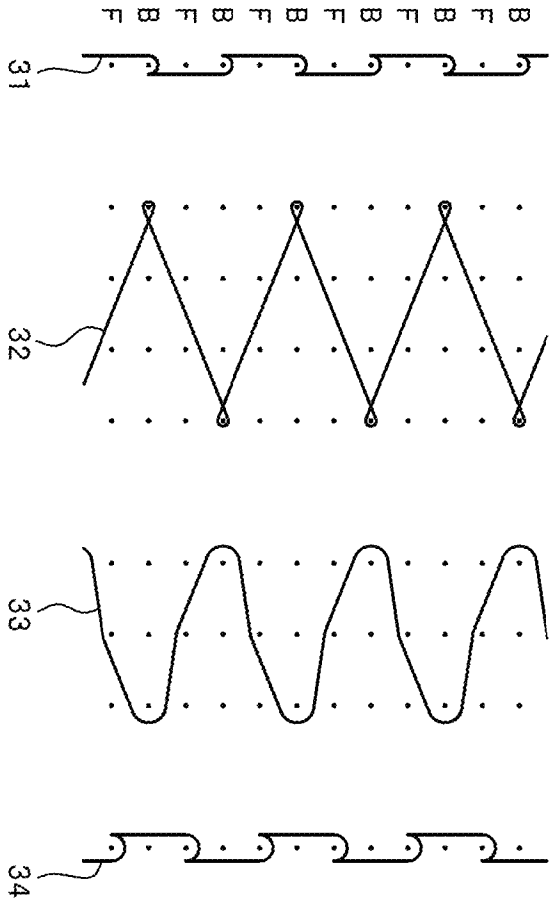
FIG. 3 is a structure diagram of each yarn that forms the knitted fastener stringer.

FIG. 1 is a plan view schematically showing a water repellent treated slide fastener of the embodiment. FIG. 2 is a structure diagram showing a knitting structure of the knitted fastener stringer of the embodiment, and FIG. 3 is a structure diagram of each yarn that forms the knitted fastener stringer. Note that, in FIG. 2 and FIG. 3, weft insertion yarns are drawn bent for not overlapping with points of the structure diagram to make them easier to see.

In the following descriptions, a front and rear direction refers to a tape length direction of a fastener tape parallel to a sliding direction of a slider, in particular, a direction in which the slider slides to engage left and right element rows (a closing direction) refers to a front, a direction in which a slider slides to separate left and right element rows (a separating direction) refers to a rear.

A left and right direction refers to a tape width direction of the fastener tape, for example, perpendicular to the sliding direction of a slider, and parallel to a top surface (an upper surface) and a back surface (a lower surface) of the fastener tape. An upper and lower direction refers to a direction perpendicular to the front and rear direction and the left and right direction, for example, a tape top and back direction perpendicular to the top surface and the back surface of the fastener tape. In the following embodiment, in particular, a direction of a side of the fastener tape on which a tab of the slider is disposed refers to an upper, a direction of the opposite side refers to a lower.

Additionally, in the knitting structure of the knitted fastener stringer, a direction parallel to the length direction of the fastener tape refers to a wale direction, and a direction perpendicular to the wale direction refers to a course direction.

A slide fastener 1 of the embodiment shown in FIG. 1 includes a pair of left and right knitted fastener stringers 10, and a slider 40 attached to left and right element rows 11 disposed on the knitted fastener stringers 10. In this case, a fastener chain is formed by the element rows 11 of the left and right fastener stringers 10 being engaged with each other over the whole length direction.

In the slide fastener 1 of the embodiment, a fastener tape 20 of the knitted fastener stringer 10 includes a tape top surface (a first tape surface), which is a surface of a side exposing outside, and a tape back surface (a second surface) disposed on the opposite side of the tape top surface. The element row 11 is disposed on the tape back surface side of the fastener tape 20. Thus, the slide fastener 1 of the embodiment is formed as so-called a back use type slide fastener of which the element rows 11 are not visible or are difficult to be visible being hidden in the back side of the fastener tape 20 in a closed state of the slide fastener 1.

The slider 40 of the embodiment is formed substantially the same as sliders used for conventional back use type slide fasteners. For this reason, detailed explanations of the slider 40 are omitted in the embodiment.

Each of the left and right fastener stringers 10 includes the fastener tape 20 that includes a tape body portion 21 and an element attaching portion 22, and a plurality of coiled continuous fastener elements 12 knitted in the element attaching portion 22. In this case, the element row 11 is formed along a length direction of the fastener tape 20 by a plurality of the fastener elements 12 knitted in the fastener tape 20.

On the tape top surface of this fastener tape 20, a film member made of synthetic resin (not shown in the drawings) is attached by adhesion. Furthermore, water repellent treatment is applied to the fastener tape 20 including the film member. Thus, the slide fastener 1 is provided with a water repellence property. Note that, the knitted fastener stringer of the present invention may be formed as a normal type knitted fastener stringer without a water repellence property by not applying water repellent treatment. The knitted fastener stringer of the present invention may also be formed without attaching the film member to the fastener tape 20.

Each of the knitted slide fasteners 1 of the embodiment is knitted by a warp knitting machine (for example, a double raschel knitting machine) having two rows of needle beds comprising a back row B and a front row F. The back row B and the front row F of the needle beds are also respectively called a back needle row and a front needle row.

The fastener elements 12 of the embodiment are formed of one monofilament made of synthetic resin, and have substantially the same form as widely known fastener elements used in conventional knitted fastener stringers. Briefly described, each fastener element 12 of the embodiment includes a coupling head portion, an upper leg portion extending from an upper end portion of the coupling head portion in a tape width direction, a lower leg portion extending from a lower end portion of the coupling head portion in the tape width direction, and a connecting portion (also referred to a reversing portion) connecting the fastener elements 12 adjacent to each other in a tape length direction.

The fastener element 12 is fixed by knitting the upper leg portion and the lower leg portion in the element attaching portion 22 with the coupling portion protruding outward from a tape side edge of the element attaching portion 22 side of the fastener tape 20 at the same time as the fastener tape 20 is knitted. Note that, in the present invention, a tape side edge of the element attaching portion 22 side of the fastener tape 20 is referred to a tape inner side edge, and a tape side edge of the opposite side is referred to a tape outer side edge. In this case, the tape inner side edge of the fastener tape 20 is a facing side edge that faces the fastener tape 20 of the knitted fastener stringer of 10 of a coupling counterpart.

The fastener tape 20 of the embodiment has a warp knitting structure knitted by the warp knitting machine described above. This fastener tape 20 includes fourteen rows of wales, which are a first wale W1 to a fourteenth wale W14 from the tape inner side edge to the tape outer side edge. In this case, the wale disposed closest to the tape inner side edge of the fastener tape 20 refers to the first wale W1, and the second wale W2 to the fourteenth wale W14 are formed from the first wale W1 toward the tape outer side edge in a sequence in a course direction. Note that, in the present invention, the number of rows of wales formed on the fastener tape 20 is not limited, it can be increased or decreased according to such as usage of the knitted fastener stringer 10.

The fastener tape 20 includes the tape body portion 21, and the element attaching portion 22 extending in a tape width direction from an inner side edge portion of the tape body portion 21 toward the side of the coupling counterpart. In this case, the element attaching portion 22 of the fastener tape 20 is formed by three rows of wales, the first wale W1 to the third wale W3. The tape body portion 21 is formed by eleven rows of wales, the fourth wale W4 to the fourteenth wale W14. Additionally, an ear portion of the fastener tape 20 is formed by the three rows of wales, the twelfth wale W12 to the fourteenth wale W14, disposed close to the tape outer side edge of the tape body portion 21.

A ground structure of the fastener tape 20 (that is, a ground structure of the tape body portion 21 and a ground structure of the element attaching portion 22) is knitted in a single structure by the back row B of the warp knitting machine. A fixing chain stitch yarn 34, which is described later, disposed on the element attaching portion 22 is knitted in a single structure by the front row F of the warp knitting machine to interlace with the ground structure of the element attaching portion 22.

The ground structure of the fastener tape 20 is knitted using three kinds of yarns, a chain stitch yarn 31, a single satin stitch yarn 32, and a weft insertion yarn 33.

The chain stich yarns 31 are knitted in a knitting structure of (0-1/1-1/1-0/0-0), and disposed on each wale from the first wale W1 to the fourteenth wale W14. The chain stitch yarn 31 of each wale has open needle loops formed on each course, and sinker loops connecting needle loops adjacent to each other in a wale direction, a plurality of needle loops are connected to each other by sinker loops, and are formed in a chain shape along a wale direction on each wale.

In the knitted fastener stringer 10 of the embodiment, the thickest yarn of all the chain stitch yarns 31 disposed on the first wale W1 to the fourteenth wale W14 is disposed as a chain stitch yarn 31*a* disposed on the first Wale W1 of the tape inner side edge. In the case of the embodiment, for example, the chain stitch yarn 31*a* disposed on the first wale W1 is 1.5 to 4 times thicker, preferably 3 times thicker, than the other chain stitch yarns 31*b* disposed on the element attaching portion 22 (in the case of the embodiment, the chain stitch yarns 31*b* disposed on the second wale W2 and the third wale W3). Specifically, the chain stitch yarn 31*a* disposed on the first wale W1 has a thickness of 310 decitex, and the chain stitch yarns 31*b* disposed on the second wale W2 and the third wale W3 have a thickness of 110 decitex.

Thus, for example, the chain stitch yarns 31*b* disposed on the second wale W2 and the third wale W3, which practically fix the fastener element 12, do not need to be made thick, and a dimension in a tape width direction (a width dimension) from a boundary portion 23 between the element attaching portion 22 and the tape body portion 21 of the fastener tape 20 to the tape inner side edge of the element attaching portion 22 can be easily secured large. As a result, in a closed state of the slide faster 1, a distance of a gap formed between the left and right fastener tapes 20 can be small as 0.35 mm or less, preferably 0.30 mm or less.

Additionally, in the embodiment, the chain stitch yarns 31*c* disposed on the twelfth wale W12 to the fourteenth wale W14 forming the ear portion of the tape body portion 21 are formed thicker than the chain stitch yarns 31*d* disposed on other than the ear portion of the tape body portion 21 (in the case of the embodiment, the chain stich yarns 31*d* disposed on the fourth wale W4 to the eleventh wale W11).

In the embodiment, for example, the chain stitch yarns 31*d* disposed on the fourth wale W4 to the eleventh wale W11 have a thickness of 110 decitex, the chain stitch yarns 31*c* disposed on the twelfth wale W12 to the fourteenth wale W14 is formed by pulling together two yarns having a thickness of 110 decitex. That is, the chain stitch yarns 31*c* disposed on the twelfth wale W12 to the fourteenth wale W14 have a thickness of 220 decitex. Thus, a long and narrow belt-shape of the fastener tape 20 can be stably maintained by using such thick yarns for the chain stitch yarns 31*c* disposed on the ear portion.

The single satin stitch yarns 32 are knitted in a knitting structure of (1-0/2-2/3-4/2-2). Each single satin stitch yarn 32 is disposed over four adjacent rows of wales. Additionally, the single satin stitch yarn 32 has closed needle loops alternately formed on two rows of wales, which are both the left and right ends of four rows of wales, and has sinker loops connect between needle loops of the wales of both ends.

The needle loops of the single satin stitch yarn 32 are alternately formed in a wale direction on two wales disposed three rows distant position from each other in a course direction. That is, two wales on which the needle loops are not formed by the single satin stitch yarns 32 are disposed between the two wales on which the needle loops of the single satin stitch yarn 32 are formed.

The sinker loops of the single satin stitch yarn 32 connect needle loops formed on one wale and needle loops formed on the other wale. For this reason, the sinker loops of the single satin stitch yarn 32 are disposed long over a distance of three stitches to across the two wales, in each interval between courses. In the embodiment, the sinker loops of each single satin stitch yarn 32 appear on the tape back surface (a tape surface of a side on which the film member is not attached) of the fastener tape 20.

In the embodiment, ten single satin stitch yarns 32 are disposed so that the needle loops of the single satin stitch yarns 32 are formed on each wale from the first wale W1 to the thirteenth wale W13. For this reason, the needle loops form each wale from the first wale W1 to the thirteenth wale W13 include both needle loops of the needle loops of the chain stitch yarn 31 and the needle loops of the single satin stitch yarn 32. On each wale from the fourth wale W4 to the thirteenth wale W 13 forming the tape body portion 21, in particular, in all knitted loops formed by the back row B, both needle loops of the needle loops of the chain stitch yarn 31 and the needle loops of the single satin stitch yarn 32 are formed. This enables the fastener tape 20 to stably have an appropriate tape strength.

On the fourteenth wale W14 formed on the outermost edge of the fastener tape 20, the needle loops of the single satin stitch yarn 32 are not formed, and only the needle loops of the chain stitch yarn 31 are formed. For this reason, when the knitted fastener stringer 10 is seen, the fastener tape 20 is more likely to give an impression of being thin or an impression of being light because an outer edge portion of the fastener tape 20 can be formed thin. It is also easier to make the fastener tape 20 felt thin when touched with fingers. Furthermore, by reducing the number of the needle loops formed on the fourteenth wale W14 compared to the number of the needle loops formed on the other wales of the tape body portion 21, the flexibility of the fastener tape 20 can be improved.

The single satin stitch yarns 32 of the embodiment include first single satin stitch yarns 32a alternately form needle loops on the wales of the element attaching portion 22 (the first wale W1, the second wale W2 or the third wale W3) and the wales of the tape body portion 21 (the fourth wale W4, the fifth wale W5 or the sixth wale W6), and second satin stitch yarns 32*b* form needle loops only on wales of the tape body portion 21.

In this case, the sinker loops of the first single satin stitch yarns 32*a* are disposed across the boundary portion 23 of the tape body portion 21 and the element attaching portion 22. Note that, the boundary portion 23 of the tape body portion 21 and the element attaching portion 22 is placed between the third wale W3 and the fourth wale W4. That is, in the embodiment, the sinker loops of the three first single satin stitch yarns 32a and the two weft insertion yarns 33 are disposed across the boundary portion 23 of the tape body portion 21 and the element attaching portion 22 in each interval between courses. Furthermore, in this case, the sinker loops of the first single satin stitch yarn 32a and the two weft insertion yarns 33 are crossed in each interval between courses as described later. Thus, the tape strength of the boundary portion 23 of the tape body portion 21 and the element attaching portion 22, and the tape strength of a part close to the boundary portion 23 are enhanced.

Furthermore, in the embodiment, each of the first single satin stitch yarns 32*a* runs across the boundary portion 23 is formed thicker than the second single satin stitch yarn 32*b*. For example, the first single satin stitch yarn 32*a* is 1.1 to 2.0 times thicker, preferably 1.4 to 1.6 times thicker than the second single satin stitch yarn 32*b*. Specifically, the first single satin stitch yarn 32*a* of the embodiment has a thickness of 167 decitex, the second single satin stitch yarn 32*b* has a thickness of 110 decitex.

Thus, the tape strength of the boundary portion 23 of the tape body portion 21 and the element attaching portion 22 and the tape strength of a part close to the boundary portion 23 are more effectively enhanced. Such a part of which the tape strength is enhanced by the first single satin stitch yarns 32*a* is a part a flange portion of the slider 40 is easy to contact in the slide fastener 1. For this reason, even if the sliding operations of the slider 40 are repeated, the fastener tape 20 is less likely to be damaged thanks to the above-described high tape strength of the fastener tape including the first single satin stitch yarns 32*a*.

In the fastener tape 20 of the embodiment, a plurality of the weft insertion yarns 33 are inserted on the whole part of wales, the first wale W1 to the fourteenth wale W14. Each weft insertion yarn 33 is respectively inserted over three wales in a zigzag pattern. By inserting the weft insertion yarn 33 over three wales as such, the speed of knitting process to knit the knitted fastener stringer 10 can be improved compared to, for example, inserting weft insertion yarns over four wales, and this enables to improve productivity and production efficiency of the slide fastener 1.

The weft insertion yarns 33 of the embodiment are inserted in a direction crossing the sinker loops of the single satin stitch yarns 32 in each interval between courses. Here, the fact the weft insertion yarns 33 and the sinker loops of the single satin stitch yarn 32 are crossed each interval between courses means a direction in which the weft insertion yarns 33 are folded back at the needle loops and a direction in which the sinker loops of the single satin stitch yarns 32 extend from the needle loops are shifted by one course in a wale direction. The fastener tape 20 can be reinforced by such weft insertion yarns 33 inserted in the fastener tape 20 while the flexibility and the texture of the fastener tape 20 are maintained properly.

In this case, the weft insertion yarn 33*a* folded back on the first wale W1 and disposed closest to the tape inner side edge is formed thinner than the other weft insertion yarns 33 disposed on the fastener tape 20. For this reason, it is possible to weaken the strength (tension) of pulling the thick chain stitch yarn 31*a* disposed on the first wale W1 in a direction approaching the tape body portion 21 by this weft insertion yarn 33*a*. Thus, it is easier to secure a dimension in the tape width direction large from the boundary portion 23 to the tape inner side edge of the element attaching portion 22. As a result, a distance of the gap formed between the left and right fastener tapes 20 can be smaller.

The fixing chain stitch yarns 34 are knitted in the second wale W2 and the third wale W3 of the element attaching portion 22 in a knitting structure of (0-0/0-1/1-1/1-0) by the front row F of the warp knitting machine as described above. That is, the ground structure of the fastener tape 20 and a knitting part of the fixing chain stitch yarns 34 are knitted in different single structures from each other respectively by the back row B and the front row F of the warp knitting machine. For this reason, the flexibility of the fastener tape 20 can be improved, and the weight reduction and the productivity of the knitted fastener stringer 10 can be enhanced.

The upper leg portions and the lower leg portions of the fastener elements 12 are inserted so that they are sandwiched between the ground structure of the element attaching portion 22 and the fixing chain stitch yarns 34. Additionally, the sinker loops of the fixing chain stitch yarns 34 are crossed and interlaced with the ground structure of the element attaching portion 22. More specifically, the sinker loops of the fixing chain stitch yarns 34 are interlaced and knitted with the sinker loops at least one of the chain stitch yarns 31 and the single satin stitch yarns 32 forming the ground structure. Thus, the fixing chain stitch yarns 34 are integrated into the ground structure of the element attaching portion 22. Furthermore, the fastener elements 12 are knitted with the fixing chain stitch yarns 34 and firmly fixed in the element attaching portion 22. In this case, the fastener elements 12 are fixed by holding the upper leg portions and the lower leg portions of the fastener element 12 between the fixing chain stitch yarns 34 and the ground structure of the element attaching portion 22.

In the embodiment, the fixing chain stitch yarns 34 include a first fixing chain stitch yarn 34*a* close to the tape inner side edge disposed on the second wale W2, and a second fixing chain stitch yarn 34*b* close to the tape body portion 21 disposed on the third wale W3. The thickest yarns of all the yarns forming the ground structure of the fastener tape 20 are used for the first fixing chain stitch yarn 34*a* and the second fixing chain stitch yarn 34*b*. In the embodiment, for example, the first fixing chain stitch yarn 34*a* and the second fixing chain stitch yarn 34*b* are formed by pulling together two yarns having a thickness of 220 decitex. Thus, the fastener elements 12 can be firmly fixed in the element attaching portion 22 so that the positions of the fastener elements 12 are not shifted.

Furthermore, the second fixing chain stitch yarn 34*b* of the embodiment is formed including two yarns having a thickness of 220 decitex and auxiliary fibers to be removed in knitting process of warp knitting of the knitted fastener stringer 10 as described later. These auxiliary fibers are pulled out from the fastener tape 20 and no longer exist after the knitting process. For this reason, in the manufactured knitted fastener stringer 10, the second fixing chain stitch yarn 34*b* is formed by the two yarns having a thickness of 220 decitex. Note that, in relation to the first fixing chain stitch yarn 34*a* of the embodiment, knitting process of the knitted fastener stringer 10 is performed without auxiliary fibers.

In the knitted fastener stringer 10 of the embodiment including the second fixing chain stitch yarns 34*b* from which such auxiliary fibers are removed, the strength to hold down the fastener elements 12 by the second fixing chain stitch yarn 34*bs* can be weaker than the strength to hold down the fastener elements 12 by the first fixing chain stitch yarns 34*a*. For this reason, in the case of the embodiment, for example, the motion of each fastener element 12 knitted in the fastener tape 20 is easier to be allowed compared to the case in which knitting process is performed without including fibers to be removed in the first fixing chain stitch yarns 34*a* and second fixing chain stitch yarns 34*b*. As a result, in the embodiment, the flexibility of the knitted fastener stringer 10 can be more effectively enhanced, and the slidability of the slider 40 of the slide fastener 1 can be more improved.

Additionally, in this case, since the knitted fastener stringer 10 is knitted without including the auxiliary fibers in the first fixing yarns 34*a*, the fastener elements 12 can be stably fixed in the element attaching portion 22. Thus, the coupling strength (the strength against pulling in width direction) of the fastener chain and the coupling strength (the strength against bending) in bending the fastener chain in the tape top and back direction can be properly secured.

Next, a manufacturing method for the knitted fastener stringer 10 of the embodiment is described.

First, knitting process of warp knitting for knitting the knitted fastener stringer 10 is performed using a warp knitting machine having two rows of needle beds comprising a back row B and a front row F. In this knitting process, while knitting the ground structure of the fastener tape 20 in a single structure by the back row B of the warp knitting machine, the needle loops of the fixing chain stitch yarns 34 are formed and the sinker loops of the fixing chain stitch yarns 34 are interlaced with the ground structure of the fastener tape 20 by the front row F. At the same time, the fastener elements 12 molded by monofilament are inserted between the ground structure of the fastener tape 20 and the fixing chain stitch yarns 34.

At this time, the ground structure of the fastener tape 20 is knitted using the chain stitch yarns 31, the single satin stitch yarns 32, and the weft insertion yarns 33 described above. Additionally, the fastener elements 12 are knitted in the fastener tape 20 using the first fixing chain stitch yarn 34*a* formed by pulling together the two yarns having a thickness of 220 decitex, and the second fixing chain stitch yarn 34*b* includes the pulled together two yarns having a thickness of 220 decitex and auxiliary fibers, as the fixing chain stitch yarns 34.

Thus, there is obtained the knitted fastener stringer 10 of which a plurality of the fastener elements 12 are knitted in the element attaching portion 22 of the fastener tape 20 at a certain interval. The knitted fastener stringer 10 thus obtained includes such a warp knitting structure as shown in FIG. 2 and FIG. 3. Note that, in this knitting process, one knitted fastener stringer 10 may be continuously manufactured, or a fastener chain may be continuously manufactured by knitting the two knitted fastener stringers 10 in a state that the left and right element rows 11 are coupled with each other.

Next, a pair of the obtained knitted fastener stringers 10 are combined and formed into a fastener chain, the auxiliary fibers included in the second fixing chain stitch yarn 34*b* are removed. And then, adhesive is applied to the tape top surface of the left and right fastener tapes 20 of the fastener chain. Subsequently, one film member made of synthetic resin is overlapped and attached to the tape top surface on which the adhesive is applied. Thus, the film member is bonded to the fastener tape 20.

Note that, in the present invention, type and material of the adhesive to bond the film member is not limited. A method and means to bond the film member to the fastener tape 20 are also not limited, and the film member may be attached to the fastener tape 20 by a method or means other than bonding.

After bonding of the film member, water repellent treatment is applied to the fastener chain on which the film member is attached. Then, by cutting the film member at a boundary portion of the left and right fastener tapes 20 along a length direction of the fastener chain, the fastener chain with a water repellence property is manufactured.

Furthermore, by attaching the slider 40 to the left and right element rows 11 of the manufactured faster chain, the slide fastener 1 with a water repellence property shown in the FIG. 1 is manufactured.

In the water repellent treated slide fastener 1 of the embodiment manufactured as above, the ground structures of the left and right fastener tapes 20 are knitted using the single satin stitch yarns 32 that forms sinker loops in each interval long between courses. For this reason, the left and right knitted fastener stringers 10 have a high flexibility.

Additionally, in the embodiment, the sinker loops of the single satin stitch yarns 32 appear long in a direction inclined to a tape width direction of the fastener tape 20 on the tape back surface in which the fastener elements 12 are knitted (in other words, the tape surface on which the film member is not attached). For this reason, the tape back surface of the fastener tape 20 is formed into a smooth surface that can obtain a pleasant hand feeling. The fastener tape 20 can also have a good texture by the single satin yarns 32.

Furthermore, in the knitted fastener stringer 10 of the embodiment, the tape strength of the boundary portion 23 between the tape body portion 21 and the element attaching portion 22 of the fastener tape 20, and a part close to the boundary portion 23 are enhanced by the three thick first single satin stitch yarns 32*a* and the two weft insertion yarns 33 as described above. Thus, the fastener tape 20 can be suppressed from damage caused by such as friction against the slider 40.

Such a slide fastener 1 of the embodiment that is soft, good in texture, and has a proper tape strength is preferred for such as clothing that has a direct contact with the skin, clothing that is formed of thin cloth, and the like.

Additionally, in the embodiment, by the thickest chain stitch yarn 31*a* being disposed on the first wale W1, a distance of the gap formed between the left and right fastener tapes in a closed state of the slide fastener 1 can be made to be 0.35 mm or less, preferably 0.30 mm or less. Thus, the coupled left and right element rows 11 can be made difficult to be visible from the tape top surface side of the fastener tape 20 through the gap between the left and right fastener tapes 20.

A length of the film member bonded to the fastener tape 20 extending from the inner side edge of the fastener tape 20 to the coupling head portion side in a tape width direction can be made short because a distance of the gap between the left and right fastener tapes 20 becomes smaller. Thus, an appearance defect such as a white line seen between the left and right fastener tapes in conventional water repellent treated slide fasteners, for example, can be made difficult to occur. As a result, an appearance quality of the water repellent treated slide fastener 1 can be improved. Furthermore, the slide fastener 1 can have a good and stable water repellence property because a distance of the gap between the left and right fastener tapes 20 becomes smaller.

Note that, although the knitted fastener stringer 10 of the embodiment described above is used for a back use type slide fastener 1, the knitted fastener stringer of the present invention can also be applied to a normal type slide fastener of which element rows expose outside.

Additionally, in the embodiment described above, in the knitting process of the knitted fastener stringer 10, the auxiliary fibers are included beforehand only in the second fixing chain stitch yarn 34*b* of the fixing chain stitch yarns 34, then the auxiliary fibers are removed after the knitting process. In the present invention, however, the auxiliary fibers may be included only in the first fixing chain stitch yarn 34*a* of the fixing chain stitch yarns 34, or the auxiliary fibers may be included in both the first fixing chain stitch yarn 34*a* and the second fixing chain stitch yarn 34*b* of the fixing chain stitch yarns 34 in the knitting process of the knitted fastener stringer 10. Alternatively, knitting process of the knitted fastener stringer 10 may be performed without including auxiliary fibers. In these cases, water-soluble fibers are used as auxiliary fibers, for example, and to remove the fibers after the knitting process includes to dissolve the water-soluble fibers by liquid.

REFERENCE SIGNS LIST

1 Slide fastener
10 Knitted fastener stringer
11 Element row
12 Fastener element
20 Fastener tape
21 Tape body portion
22 Element attaching portion
23 Boundary portion between element attaching portion and tape body portion

31 Chain stitch yarn

31*a* Chain stitch yarn disposed in first wale

31*b* Chain stitch yarns disposed in second wale and third wale

31*c* Chain stitch yarns disposed in twelfth wale to fourteenth wale

31*d* Chain stitch yarns disposed in fourth wale to eleventh wale

32 Single satin stitch yarn

32*a* First single satin stitch yarn

32*b* Second single satin stitch yarn

33 Weft insertion yarn

33*a* Weft insertion yarn disposed closest to tape inner side edge

34 Fixing chain stitch yarn

34*a* First fixing chain stitch yarn

34*b* Second fixing chain stitch yarn

40 Slider

B Back row of needle bed

F Front row of needle bed

W1 to W14 First wale to fourteenth wale

The invention claimed is:

1. A knitted fastener stringer, comprising a fastener tape including a warp knitting structure, and a plurality of fastener elements formed of monofilament made of synthetic resin, wherein the fastener tape includes a tape body portion, and an element attaching portion extending from one side edge portion of the tape body portion in a tape width direction and in which a part of the fastener elements is knitted, wherein the fastener tape includes a plurality of chain stitch yarns forming a plurality of needle loops in a chain shape along a wale direction, wherein the fastener tape includes a ground structure knitted in a single structure by the chain stitch yarns, a single satin stitch yarn that alternately forms needle loops on two wales disposed three rows distant from each other, and a weft insertion yarn inserted over a plurality of wales in a zigzag pattern, and the chain stitch yarn disposed on an innermost edge wale furthest from the tape body portion of the element attaching portion is the thickest of all the chain stitch yarns used in the ground structure of the fastener tape.

2. The knitted fastener stringer according to claim 1, wherein the fastener elements are inserted and knitted between the ground structure of the fastener tape and a fixing chain stitch yarn knitted in a single structure.

3. The knitted fastener stringer according to claim 2, wherein at least three single satin stitch yarns and at least two weft insertion yarns are disposed in directions crossing each other in an interval between wales being a boundary portion of the tape body portion and the element attaching portion.

4. The knitted fastener stringer according to claim 2, wherein the single satin stitch yarn includes a first single satin stitch yarn that alternately forms needle loops on a wale of the element attaching portion and on a wale of the tape body portion, and a second single satin stitch yarn that alternately forms needle loops on two wales of the tape body portion, and the first single satin stitch yarn is thicker than the second single satin stitch yarn.

5. The knitted fastener stringer according to claim 2, wherein the needle loops that form the outermost edge wale of the tape body portion disposed on the most distant position from the element attaching portion, include only needle loops of the chain stitch yarn of the outermost edge wale, and the needle loops that form wales except the outermost edge wale of the tape body portion include the needle loops of the chain stitch yarn and the needle loops of the single satin stitch yarn.

6. A fastener chain including two knitted fastener stringers according to claim 1.

7. The fastener chain according to claim 6, wherein a distance between two fastener tapes of the two knitted fastener stringers is 0.35 mm or less.

8. The fastener chain according to claim 6, wherein the fastener tape includes a first tape surface on the side which the fastener elements are knitted, and a second tape surface on the opposite side of the first tape surface, and a film member made of synthetic resin is attached on the second tape surface of the fastener tape.

9. A manufacturing method for a knitted fastener stringer comprising a fastener tape including a warp knitting structure, and a plurality of fastener elements formed of monofilament made of synthetic resin, wherein the fastener tape includes a tape body portion, and an element attaching portion extending from one side edge portion of the tape body portion in a tape width direction and in which a part of the fastener elements is knitted, wherein the fastener tape includes a plurality of chain stitch yarns forming a plurality of needle loops in a chain shape along a wale direction, and wherein the method including knitting a ground structure of the fastener tape in a single structure by using the chain stitch yarns, a single satin stitch yarn that alternately forms needle loops on two wales disposed three rows distant from each other, and a weft insertion yarn inserted over a plurality of wales in a zigzag pattern, and using a thickest yarn of all the chain stitch yarns used in the ground structure of the fastener tape for the chain stitch yarn disposed on an innermost edge wale furthest from the tape body portion of the element attaching portion.

10. The manufacturing method for the knitted fastener stringer according to claim 9, wherein the method including inserting and knitting the fastener elements between a ground structure of the fastener tape and a fixing chain stitch yarn knitted in a single structure while knitting the ground structure of the fastener tape.

* * * * *